United States Patent [19]

Inoue

[11] Patent Number: 4,706,528

[45] Date of Patent: Nov. 17, 1987

[54] ADJUSTABLE WRENCH

[75] Inventor: Isao Inoue, Sanjo, Japan

[73] Assignee: Daiya Seiko Kabushiki-Kaisha, Niigata, Japan

[21] Appl. No.: 920,912

[22] Filed: Oct. 21, 1986

Related U.S. Application Data

[63] Continuation of Ser. No. 216,152, Dec. 15, 1980, abandoned, and Ser. No. 491,278, May 4, 1983, abandoned.

[51] Int. Cl.[4] ..... B25B 13/12

[52] U.S. Cl. ..... 81/179; 81/129

[58] Field of Search ..... 81/179, 58, 126, 129

[56] References Cited

U.S. PATENT DOCUMENTS

| | | | |
|---|---|---|---|
| 1,512,363 | 10/1924 | Phleger | 81/179 X |
| 1,575,593 | 3/1926 | Seiter | 81/179 |
| 2,600,693 | 6/1952 | Rutherford | 81/179 |
| 2,692,524 | 10/1954 | Grant et al. | 81/179 |
| 2,721,493 | 10/1955 | Bergland | 81/179 |
| 2,929,287 | 3/1960 | Wolbaum | 81/179 X |
| 2,959,996 | 11/1960 | Wheeler | 81/179 |

*Primary Examiner*—Frederick R. Schmidt
*Assistant Examiner*—Bradley I. Vaught
*Attorney, Agent, or Firm*—John E. Reilly

[57] ABSTRACT

An adjustable wrench having a fixed jaw, an adjustable jaw which is movable to adjust the gripping distance between the fixed jaw and the adjustable jaw, a sliding jaw portion which is provided as a gripping member on either of the fixed jaw or the adjustable jaw and serves as a wedge to decrease the gripping distance between both the jaws in its sliding in one direction, and a mechanism which automatically returns the sliding jaw portion to its original retracted position.

1 Claim, 14 Drawing Figures

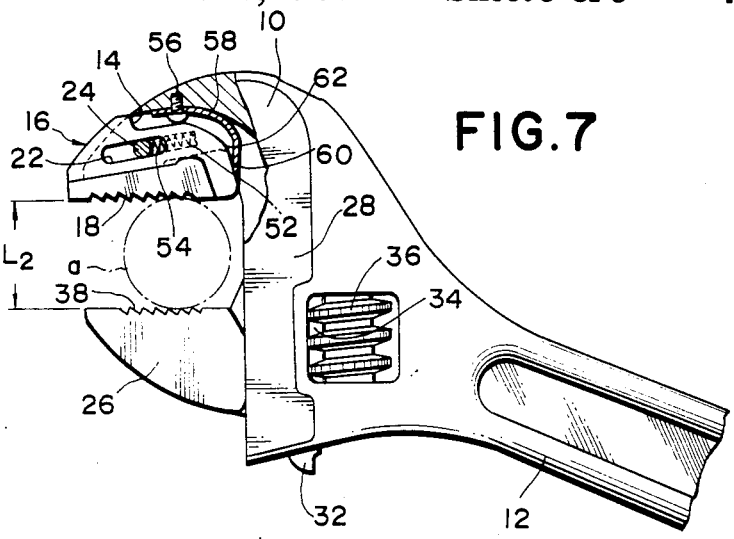
FIG.7
FIG.8
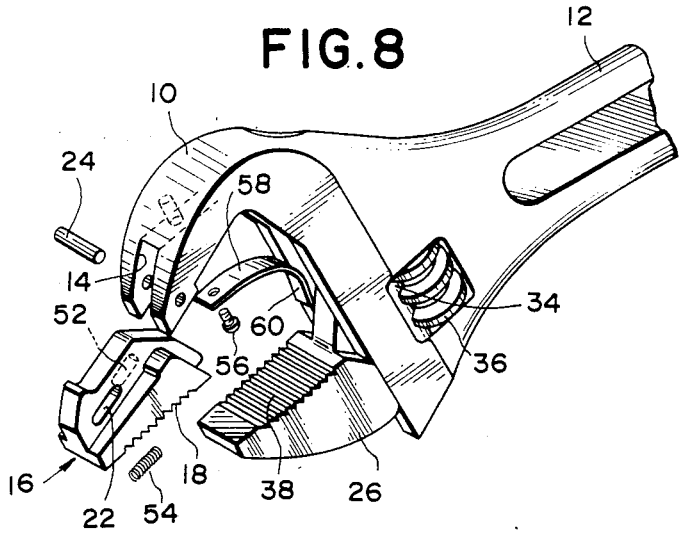
FIG.9
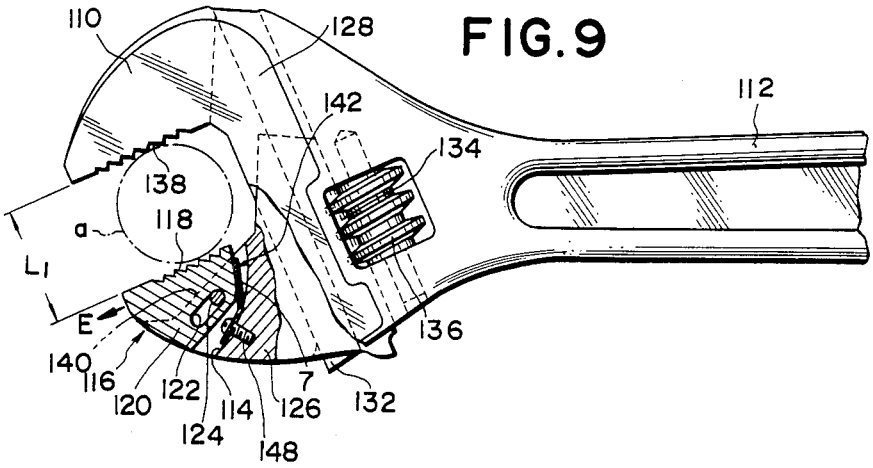

ADJUSTABLE WRENCH

This application is a continuation application of previous Ser. Nos. 216,152 and 491,278, filed Dec. 15, 1980 and May 4, 1983 respectively, for ADJUSTABLE WRENCH, invented by Isao Inoue both now abandoned.

This invention relates to an adjustable wrench and more particularly relates to an open-end wrench for adjustably fixing the gripping distance of the wrench jaws.

BACKGROUND AND FIELD OF THE INVENTION

The field or art to which the invention pertains includes an adjustable open-end wrench or pipe wrench. Conventionally, an open-end wrench has been used to turn a bolt or nut of hexagonal or rectangular shape having two opposite sides or a similar periphery or to tighten or release a coupling or the like, but has been incapable of gripping a pipe and the like having a circular periphery since its jaws are fixed for a certain size. Therefore, to grip and rotate objects having a circular periphery, a pipe wrench is exclusively employed. The pipe wrench, however, is unsuitable for turning a bolt or nut since the adjustable jaw of the pipe wrench is designed to bite the surface of an object to be turned. Particularly, when turning not only bolts and nuts but pipes, a crescent wrench and a pipe wrench must be exchanged frequently. This is very cumbersome. Therefore, the demand for an adjustable wrench which can be used both as a crescent wrench and a pipe wrench has been strong.

SUMMARY OF THE INVENTION

Accordingly, it is an object of the present invention to provide a novel and improved adjustable wrench which can be used as a crescent wrench and a pipe wrench.

It is another object of the present invention to provide an adjustable wrench which can be handled in a manner similar to a crescent wrench or pipe wrench without need for special skill.

To achieve the above-mentioned objects, an adjustable wrench according to the present invention consists of a body having a fixed jaw and an adjustable jaw facing thereto, any one of the two jaws incorporating slidably a wedge-shaped sliding jaw portion on its gripping surface so as to grip an object to be rotated between the sliding jaw and the opposite jaw irrespective of the geometric configuration of the object. Moreover, to further accomplish the above-mentioned objects, an automatic return mechanism is provided for the sliding jaw so that the sliding jaw is returned automatically into a predetermined expanded position with respect to the fixed jaw or the adjustable jaw, the return mechanism preferably being in the form of a spring mechanism incorporated in a unique manner into the jaw portion.

BRIEF DESCRIPTION OF THE DRAWINGS

The above and other objects, advantages and features of the present invention will become more readily appreciated and understood from the foregoing detailed description of preferred and alternate embodiments when taken together with the accompanying drawings, in which:

FIG. 7 is an elevational fragmentary view of a head and handle portion with parts partially broken away as shown in FIG. 6 in operation;

FIG. 8 is a perspective, exploded view of major parts shown in FIG. 6;

FIG. 9 is an elevational fragmentary view of a head and handle portion with parts partially broken away of still another alternate embodiment according to the present invention;

DETAILED DESCRIPTION OF THE PREFERRED EMBODIMENT

Figure 1:
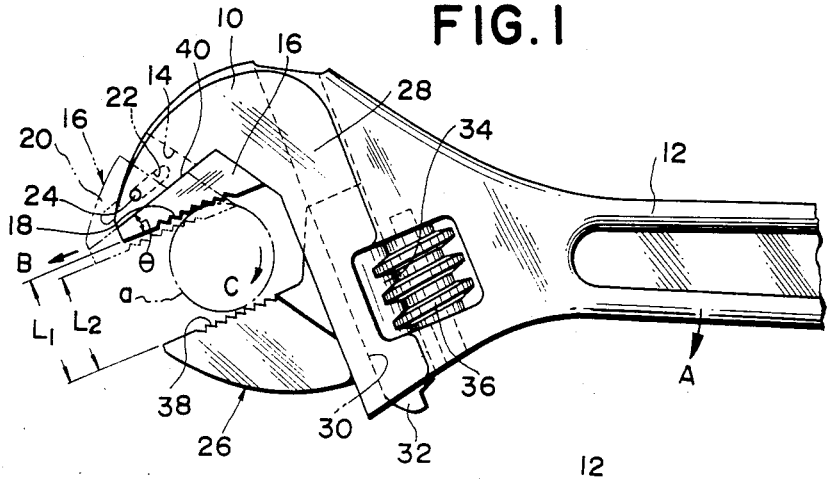
FIG. 1 is an elevational fragmentary view of a head and portion of the handle of the preferred embodiment according to the present invention.
Figure 2:
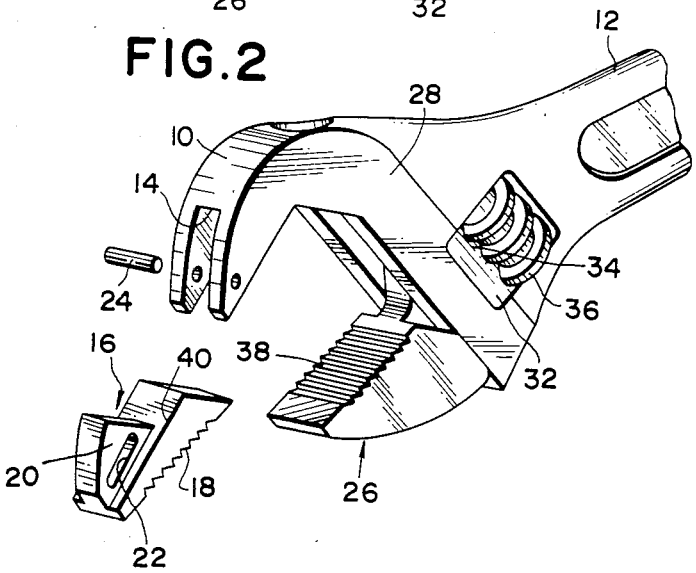
FIG. 2 is a perspective, exploded view of major parts shown in FIG. 1.

Referring now to FIGS. 1 and 2, the operating principle and the first preferred embodiment of the present invention will be explained. A wrench having a fixed jaw 10 is provided as a unitary extension of the head or body 28 at the forward end of a handle 12, and an open slot 14 is formed facing forward at a leading edge of the fixed jaw 10. A sliding jaw portion 16 has teeth 18 on its underside and a wedge-shaped or triangular projection 20 on its upper side which is slidably inserted in the slot 14. More specifically, a shaft or pin 24 bridging the slot 14, passes transversely through a slot 22 of the projection 20 to allow sliding of the sliding jaw portion 16. In a well-known manner, an adjustable jaw 26 which is disposed in facing relation to the sliding jaw portion 16 has a rack portion 32 which is slidably engaged in a groove 30 formed in the head 28 of the wrench and its rack is meshed with a worm 30 which is also used as a manually adjustable knob and mounted on a shaft so as to adjust the distance between both the jaws 10 and 26. An inside edge or gripping surface of the adjustable jaw 26 is provided with teeth 38. Teeth 18 of the sliding jaw 16 and teeth 38 of the adjustable jaw 26 are arranged in substantially parallel spaced relation to one another. The sliding jaw portion 16 has a wedge-shaped body provided with an inclined bearing surface 40 adapted to slide along a complementary bearing surface on the fixed jaw, the bearing surfaces being inclined at an angle of $\theta$ to the teeth 18.

The above-mentioned wrench is used to turn a bolt or nut in such a manner that its hexagonal head is placed between the sliding jaw portion 16 at the fixed jaw 10 and the adjusting jaw 26, and then its opposite sides are gripping by the teeth 18 and 38 of the jaws 16 and 26 when the adjustable jaw 26 is shifted by rotating the worm 36. In this case, the sliding jaw portion 16 does not move toward an edge of the fixed jaw 10 since it works as a wedge with an angle to $\theta$.

When a pipe a or similar object having circular periphery is to be turned, the pipe a is gripped with both jaws 16 and 26 by rotating the worm 36, and the handle 12 is moved in the direction of A. By movement of the handle 12, the sliding jaw portion 16 slides toward the edge of the fixed jaw 10 in the direction of B while the teeth 18 are slightly engaged with the pipe a. As a result, the sliding jaw portion 16 works as a wedge, and the distance between both teeth 18 and 28 is reduced from $L_1$ to $L_2$. Therefore, both teeth 18 and 28 catch the pipe a, thus turning it positively.

On the contrary, when the handle 12 is moved in the reverse direction of A, the sliding jaw slides in the direction opposite to the edge of the fixed jaw 10 whereby the distance between the teeth 18 and 26 slip over or are released from the pipe a. When the above-mentioned operation is repeated; that is, the handle 12 is swung repeatedly, the pipe a is turned in the direction of C. This action is the same as that of a ratchet type of pipe wrench.

DETAILED DESCRIPTION OF ALTERNATE EMBODIMENTS OF THE PRESENT INVENTION

Figure 3:
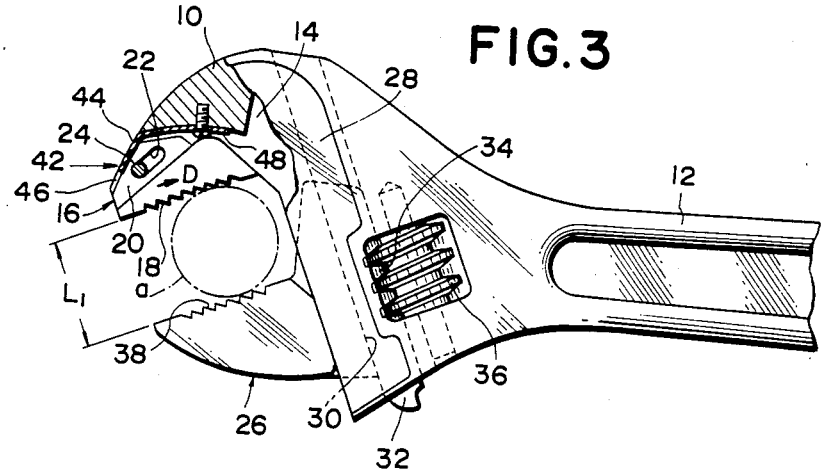
FIG. 3 is an elevational view of a head and handle portion with parts partially broken away of an alternate embodiment according to the present invention.
Figure 4:
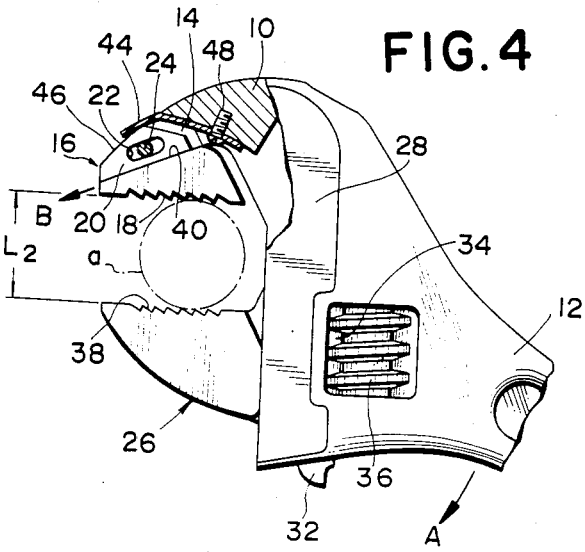
FIG. 4 is an elevational fragmentary view of the head and handle portion with parts partially broken away as shown in FIG. 3 in operation.
Figure 5:
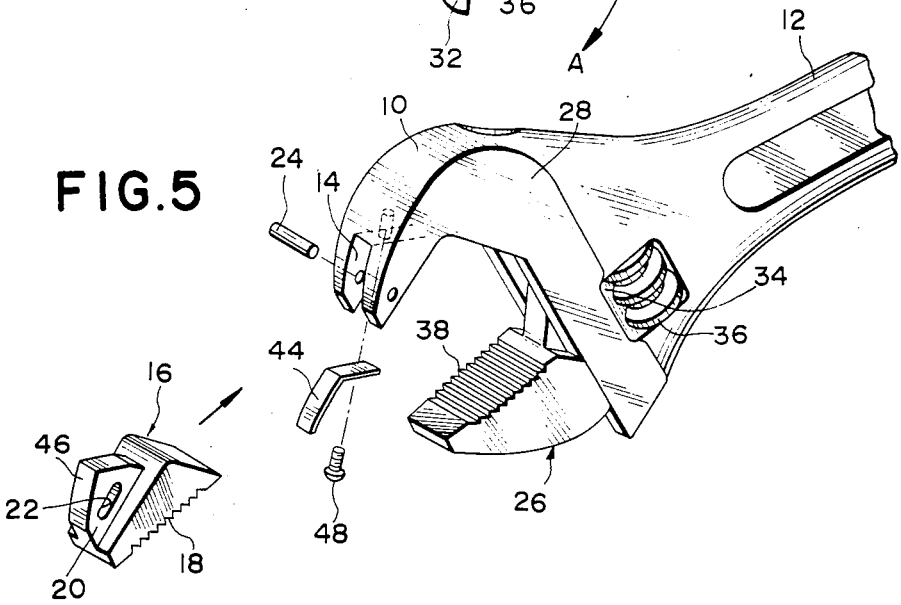
FIG. 5 is a perspective, exploded view of major parts shown in FIG. 3.

FIGS. 3 to 5 show an alternate embodiment according to the present invention in which like parts are correspondingly enumerated to those of FIGS. 1 and 2; and wherein an automatic return mechanism 42 is provided for insuring the abovementioned action of the sliding jaw 16. In this embodiment, a plate spring 44 made of spring steel has a base portion secured to the bottom of the slot 14 by a small screw 48 so that an end of the plate spring 44 is in contact with an inclined surface 46 on the top end or projection 20 of the sliding jaw 16.

Therefore, the sliding jaw 16 is always pressed toward the head 28 in the direction of D by the plate spring 44 in returning it into a constant retracted position. As a result, the teeth can be easily released from the pipe a when turning the pipe with this wrench.

Figure 6:
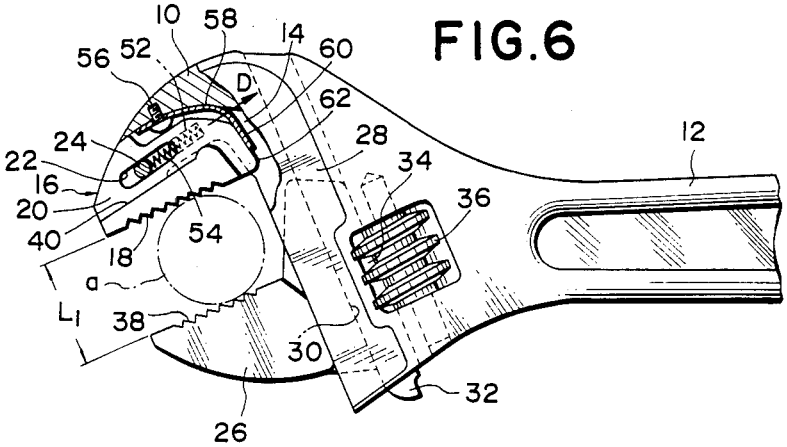
FIG. 6 is an elevational fragmentary view of a head and handle portion with parts partially broken away of another alternate embodiment according to the present invention.

FIGS. 6 to 8 show a modified sliding jaw portion 16 in which the automatic return mechanism 50 consists of a hole 52 at one end of a slot 22 formed at the top end 20 of the sliding jaw 16, a coil spring 54 which is inserted between the shaft 24 and the hole 52 to press the sliding jaw 16 itself in the direction of D, and a plate spring 58 whose one end is secured to the bottom of the slot 14 by a small screw 56 and whose bent end 60 is in contact with an edge 62 of the sliding jaw 16.

When the pipe a is rotated by the above-mentioned wrench, the wedge-shaped sliding jaw 16 first slides slightly in the direction of D, and then it is returned by the force of the plate spring 58 so that the distance between the teeth 18 and 38 is decreased. When the handle 12 is moved in the direction of A, the teeth 18 and 38 remain engaged with the external periphery of the pipe a. Thus, with the help of the coil spring 54 which adjusts the distance between the teeth 18 and 38, smooth rotation of the pipe a can be achieved by this wrench.

Figure 10:
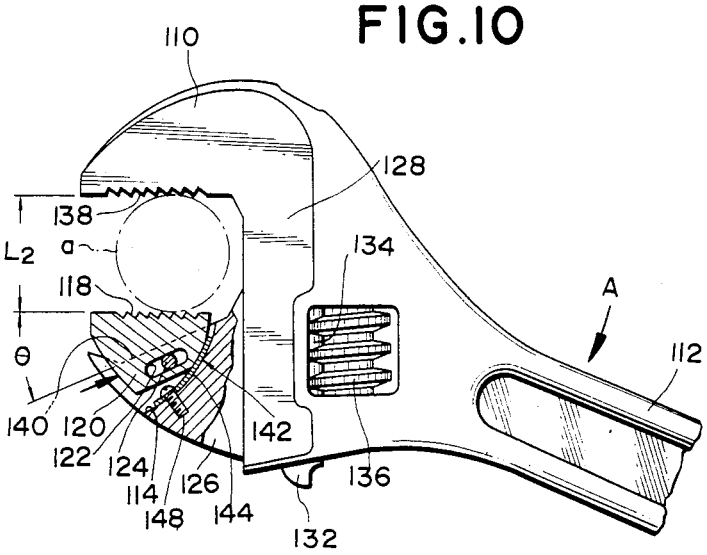
FIG. 10 is an elevational fragmentary view of a head and handle portion with parts partially broken away as shown in FIG. 9.
Figure 11:
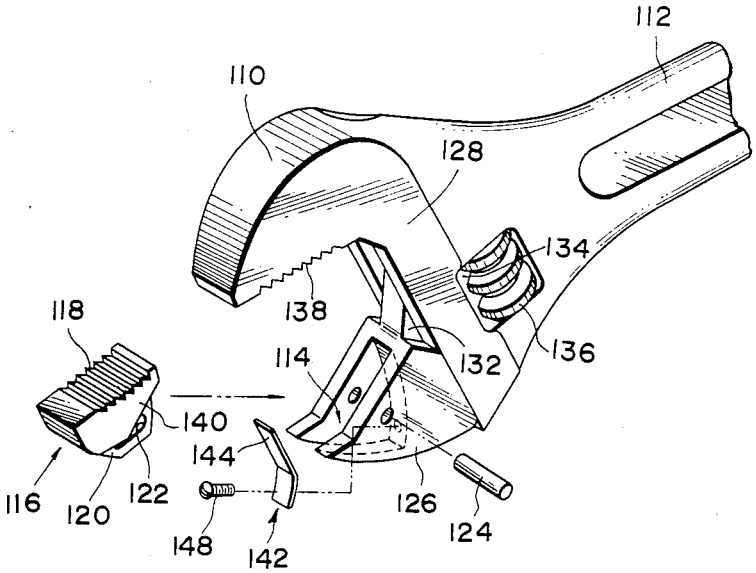
FIG. 11 is a perspective, exploded view of major parts shown in FIG. 9.

FIGS. 9 to 11 show another embodiment in which a sliding jaw 116 is attached to an adjustable jaw 126. As shown, teeth 138 are formed on the inside edge of a fixed jaw 110 provided at the top end of a handle 112, and a rack portion 132 of the adjustable jaw 126, which faces the fixed jaw 110 is slidably engaged in a base 138 of the fixed jaw 110 so that the distance between the teeth 138 and teeth 118 of the sliding jaw 116 are adjusted by the movement of a rack 134 and a worm 136. The sliding jaw 116 has the teeth 118 on its upper side and a projection 120 on its lower side is slidably engaged in a slot 114 formed in the adjustable jaw 126. The projection 120 has a slot 122 through which a shaft 124, bridging the slot 114, passes thus allowing the movement of the sliding jaw 116 along an inclined surface 140. The teeth 138 of the fixed jaw 110 and the teeth 118 of the sliding jaw 117 are substantially parallel. The wedge-shaped sliding jaw 116 has a sliding or inclined bearing surface 140 at an angle of $\theta$ to the teeth 118. An automatic return mechanism 142 consists of a plate spring 144 whose one end is secured to the bottom of the slot 114 by a small screw 148, and whose other end is in contact with an edge of the sliding jaw 116 so as to press the sliding jaw 116 in the direction of E.

Therefore, when the handle 112 is moved in the direction of A with the pipe a inserted between the teeth 138 and 118 of the fixed jaw 110 and the sliding jaw 116, the sliding jaw 117 slides in the reverse direction of E, contrary to the previous embodiments. With this wedge effect of the sliding jaw 116, the distance between both teeth 138 and 118 is decreased, thus achieving the same engagement as in the previous embodiments.

Figure 12:
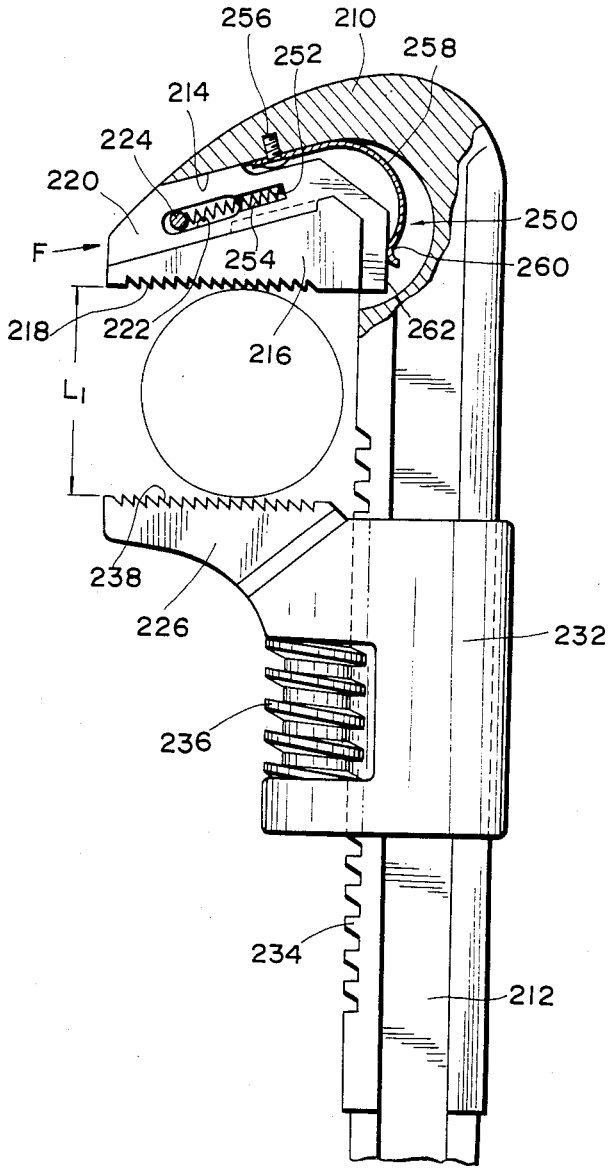
FIG. 12 is an elevational fragmentary view of a head and handle portion with parts partially broken away of another modified form according to the present invention.
Figure 13:
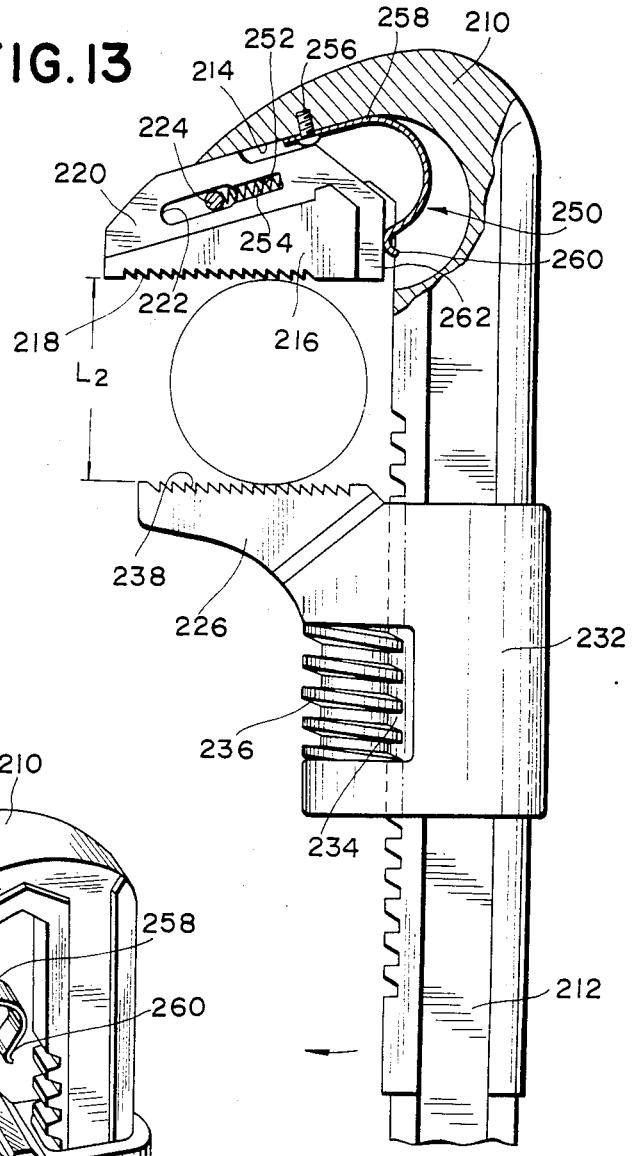
FIG. 13 is an elevational fragmentary view of a head and handle portion with parts partially broken away as shown in FIG. 12.
Figure 14:
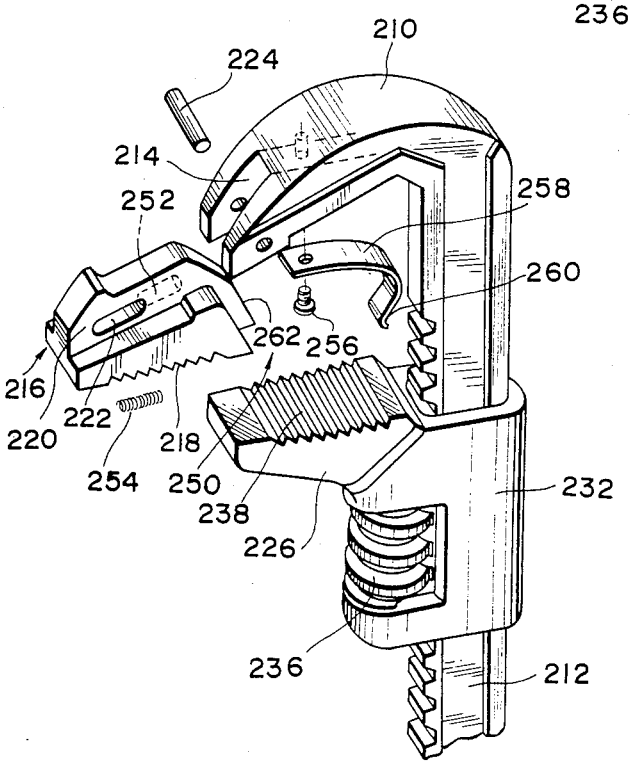
FIG. 14 is a perspective, exploded view of major parts shown in FIG. 12.

FIGS. 12 to 14 show an adjustable wrench which has a fixed jaw 210 in which a wedge-shaped sliding jaw 216 is built. This wrench consists of a fixed jaw 210 which is integrally formed at one end of a straight handle 212 and protruded sideways, and an adjustable base 232 which slidably mounts on the handle 212 has an adjustable jaw 226 protruding therefrom.

A worm 236 mounted on a shaft in the adjustable base 232 is engaged with a rack 234 disposed on one side of the handle 212 so as to adjust the distance between the fixed jaw 210 and the adjustable jaw 226 whose inside is formed with teeth 238. The forward end of the fixed jaw 210 is provided with an open slot 214 in which a projection 220 of a wedge-shaped sliding jaw 216 is slidably engaged. A shaft 224 passes through a slot 222 of the projection 220 and bridges the open slot 214 with opposite ends thereof anchored in aligned opening in the sidewalls of the open slot 214 so that the sliding jaw 216 can slide on the shaft 224.

A return mechanism 250 for the sliding jaw 216 consists of a hole 252 which is provided at one end of the slot 222 formed at top end 220 of the sliding jaw 216, a coil spring 254 which is provided between the shaft 224 and the hole 252 so as to press the sliding jaw 216 in the direction of F, and a plate spring 258 whose one end is secured to the bottom of the slot 214 by a small screw 256 and whose bent end 260 is in contact with an edge 262 of the sliding jaw 216 and is biased to press the sliding jaw 216 against the force of the coil spring 254. Teeth 218 are formed on the inside surface of the sliding jaw 216.

The above-mentioned wrench is used in such a manner that an external periphery of a pipe a is gripped with the teeth 218 and 238 of the sliding jaw 216 and the adjustable jaw 226 by rotating the worm 236 at the adjustable base 232, and the handle 212 is swung repeatedly. During this operation, the distance between both jaws 216 and 228 is reduced from $L_1$ to $L_2$ by the movement of the sliding jaw 216, similar to the previous embodiments. As a result, teeth 218 and 238 bite the external periphery of pipe a.

As described above, each wrench in the embodiments described is capable of turning not only hexagonal bolts and nuts but pipes or similar objects with circular peripheries in normal handling practice. Therefore, each wrench can be used interchangeably as a pipe wrench or crescent wrench whlie exhibiting a ratcheting action in alternately releasing and engaging an object.

Furthermore, with the return mechanism built in the sliding jaw as mentioned above, the teeth can be easily released from the external periphery of a pipe, no slippage is experienced during gripping and smooth operation can be achieved.

It is therefore to be understood that various modifications and changes may be made in the construction and arrangement of parts comprising the various embodiments of invention as described herein without departing from the spirit. and scope of the invention as defined by the appended claims and reasonable equivalents thereof.

I claim:

1. In an adjustable open-end wrench for gripping and turning an object wherein said wrench is provided with a handle, a head at one end of said handle having a fixed jaw portion and an inclined bearing surface on said fixed jaw portion, an adjustable jaw disposed in confronting relation to said fixed jaw portion, and means for controlling the movement of said adjustable jaw toward and away from said fixed jaw portion to regulate the gripping distance therebetween, the improvement comprising:

a slidable jaw portion of generally wedge-shaped configuration having an inclined bearing surface complementary to said inclined bearing surface on said fixed jaw portion, said inclined bearing surfaces being sloped to extend at a low gradual angle away from said head and toward said adjustable jaw, said slidable jaw portion provided with a gripping surface thereon, and mounting means for mounting said slidable jaw portion on said fixed jaw portion such that said gripping surface is disposed in confronting relation to said adjustable jaw, said mounting means including a wedge-shaped projection extending in a direction away from said gripping surface and inserted into an open slot in said fixed jaw portion, said projection provided with a pin-receiving, elongated slot, a pin mounted in stationary relation to said fixed jaw portion for extension across said open slot and through said pin-receiving, elongated slot in a direction transversely of the length of said slot; and first spring means disposed in said pin-receiving, elongated slot between said pin and an end of said pin-receiving, elongated slot to urge said slidable jaw portion in a direction toward said head, second spring means in the form of a plate spring member mounted in the bottom of said open slot and having biasing means at one end of said plate spring member pressing against a surface of said wedge-shaped projection to yieldingly urge said slidable jaw portion in a direction to decrease the gripping distance between said fixed jaw portion and said adjustbale jaw, said open slot and said projection being elongated in a direction substantially parallel to said inclined bearing surfaces so that said slidable jaw portion is slidable in a direction away from said head to overcome the urging of said first spring means and reduce the gripping distance betwen said fixed jaw portion and said adjustable jaw in response to gripping and turning of an object in one direction and being further movable in a return direction toward said head under the urging of said first spring means to increase the gripping distance between said fixed jaw portion and said adjustable jaw when the object is released.

* * * * *